US008563901B2

(12) United States Patent
Hitchcock et al.

(10) Patent No.: US 8,563,901 B2
(45) Date of Patent: Oct. 22, 2013

(54) METHOD AND APPARATUS FOR TOP HEAT BAKE ASSIST IN A GAS OVEN APPLIANCE

(75) Inventors: Michael Bernard Hitchcock, Louisville, KY (US); Philip Ames Barber, Louisville, KY (US); John Mark Chilton, Campbellsburg, KY (US); Michael Thomas Chezem, Georgetown, IN (US); Leo Edward Hodapp, Jr., Greenville, IN (US)

(73) Assignee: General Electric Company, Schenectady, NY (US)

( * ) Notice: Subject to any disclaimer, the term of this patent is extended or adjusted under 35 U.S.C. 154(b) by 387 days.

(21) Appl. No.: 12/984,668

(22) Filed: Jan. 5, 2011

(65) Prior Publication Data

US 2012/0168423 A1 Jul. 5, 2012

(51) Int. Cl.

| | |
|---|---|
| ***A21B 1/06*** | (2006.01) |
| ***A21B 1/22*** | (2006.01) |
| ***A21B 1/40*** | (2006.01) |

(52) U.S. Cl.

USPC ..... 219/413; 219/391; 219/486; 219/492; 219/494; 99/328; 99/333; 126/39 BA

(58) Field of Classification Search

None

See application file for complete search history.

(56) References Cited

U.S. PATENT DOCUMENTS

| | | | | |
|---|---|---|---|---|
| 3,303,326 | A * | 2/1967 | Holtkamp | 219/494 |
| 4,493,976 | A * | 1/1985 | Wilson | 219/398 |
| 5,039,535 | A * | 8/1991 | Lang et al. | 426/233 |
| 6,222,163 | B1 * | 4/2001 | Arntz et al. | 219/483 |
| 6,232,582 | B1 * | 5/2001 | Minnear et al. | 219/497 |
| 6,570,136 | B1 * | 5/2003 | Lockwood et al. | 219/398 |
| 6,727,478 | B2 * | 4/2004 | Rael et al. | 219/506 |
| 6,734,403 | B2 * | 5/2004 | Baker et al. | 219/486 |
| 7,759,617 | B2 | 7/2010 | Bowles et al. | |
| 2003/0015518 | A1 * | 1/2003 | Baker et al. | 219/486 |
| 2003/0146205 | A1 * | 8/2003 | Rael et al. | 219/506 |
| 2007/0039945 | A1 * | 2/2007 | Stockley | 219/486 |
| 2010/0140248 | A1 * | 6/2010 | Yi et al. | 219/391 |
| 2011/0091830 | A1 * | 4/2011 | Trice et al. | 432/1 |
| 2011/0266271 | A1 * | 11/2011 | Boyer et al. | 219/393 |

* cited by examiner

*Primary Examiner* — Joseph M Pelham

(74) *Attorney, Agent, or Firm* — Dority & Manning, P.A.

(57) ABSTRACT

A method and apparatus are described for providing top heat to assist with baking in an oven appliance having a gas bake burner. The top heat is provided by a heating element positioned in the top of the oven cavity. This top heating element is operated in a manner that assists the bottom, gas bake burner with properly browning the food on both its top and bottom. The operation of the both the top heating element and the gas bake burner can be varied to provide proper cooking and browning based upon e.g., the type of food being cooked, the amount of food being cooked, and the level of browning desired.

20 Claims, 2 Drawing Sheets

METHOD AND APPARATUS FOR TOP HEAT BAKE ASSIST IN A GAS OVEN APPLIANCE

FIELD OF THE INVENTION

The present invention relates to a method and apparatus for providing top heat to assist with baking in an oven appliance having a gas bake burner.

BACKGROUND OF THE INVENTION

A conventional gas oven appliance typically includes a single gas burner that is located at the bottom of a cavity defined by the oven's cabinet. In such configuration, this gas bake burner is the only source of heat, which is supplied from the bottom of the oven cavity. The heat from this element will travel to the top of the oven cavity by e.g., natural convection. Temperature gradients can exist within the oven, especially during heating cycles, due to the bottom position of the gas burner.

For certain food items, the positioning of a single gas burner at the bottom of the oven cavity creates problems in achieving the proper browning of the food. More particularly, when the primary source of heat is from the bottom of the oven cavity, it is difficult for an oven designer to optimize the performance of the oven so that food is properly browned both on the top and bottom of the food. Typically, a change that improves browning of food along its bottom will have a negative impact on proper browning of the food along its top. For example, operating the oven in a manner that provides ideal browning for the bottom of the food can result in the top of the food being undercooked or not properly browned. Similarly, improving the browning of the top of the food can result in the bottom being undercooked or not properly browned. Unfortunately, simply applying more heat may not prove satisfactory. For example, applying more heat from the bottom of the oven cavity in order to provide more browning to the top of the food can result in the bottom portion of the food being overcooked or even scorched.

Several effects may explain the challenges to properly browning food with a single gas burner positioned at the bottom of the oven cavity. As mentioned, temperature gradients can exist over the oven cavity, particularly during a heating cycle, due to the positioning of the heat source at the bottom. After the gas burner is ignited or its output is increased, a certain period of time is required before the heat can be conducted throughout the rest of the oven so that temperature is more uniform. In addition, radiant heat contributes to the proper browning of food. Typically, food is placed into the oven in a pan or other utensil and, as such, this negatively affects the ability of a gas bake burner positioned at the bottom of the oven to properly brown the top of the food.

Accordingly, an oven appliance that can provide for the proper browning of food would be helpful. More particularly, an oven appliance that can cook food while properly browning both the top and bottom of the food would be beneficial. Such an appliance that uses a gas fueled, bake burner would also be very useful.

BRIEF DESCRIPTION OF THE INVENTION

Aspects and advantages of the invention will be set forth in part in the following description, or may be obvious from the description, or may be learned through practice of the invention.

In one exemplary aspect of the present invention, a method for operating an oven cooking appliance is provided. The oven has a top heating element and a bottom heating element. The bottom heating element is gas fueled. The method includes the steps of activating the top heating element for a predetermined period of time if the oven temperature is less than a first predetermined temperature; deactivating the top heating element after the expiration of the predetermined interval of time; activating the bottom heating element until the oven temperature reaches a second predetermined temperature; and deactivating the bottom heating element after the oven reaches the second predetermined temperature.

In another exemplary embodiment of the present invention, an oven appliance for cooking is provided. The oven appliance includes a top heating element; a bottom heating element; and a cavity for receipt of a food for cooking. One or more processing devices are included and are configured for activating the top heating element for a predetermined period of time if the oven temperature is less than a first predetermined temperature; deactivating the top heating element after the expiration of the predetermined period of time; activating the bottom heating element until the oven temperature reaches a second predetermined temperature; and deactivating the bottom heating element after the oven reaches the second predetermined temperature.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
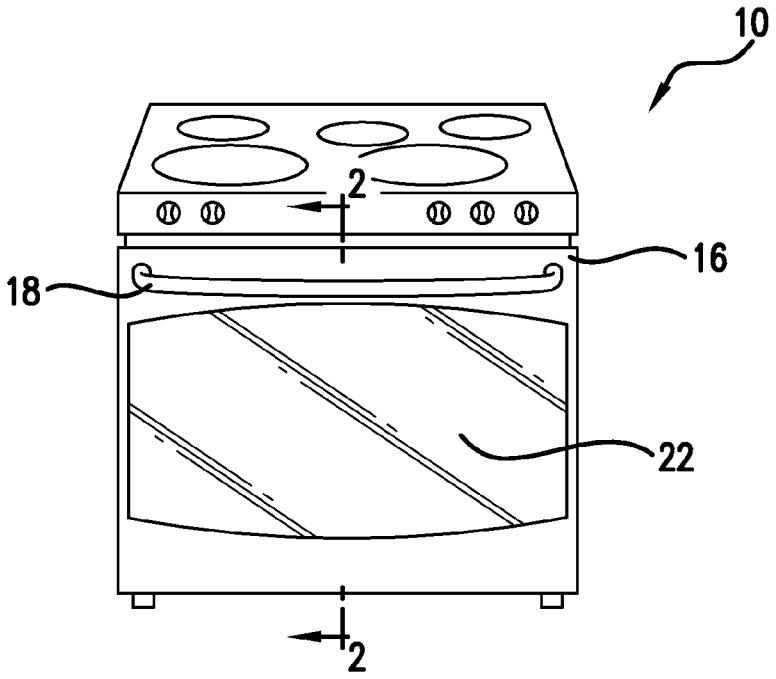
FIG. 1 is a front view of an exemplary embodiment of an oven range appliance as may be used with the present invention. Such appliance is provided by way of example only. Other oven appliance configurations may also be used including e.g., double ovens, slide-in types for installation into cabinetry, and still others as well.

The present invention relates to a method and apparatus for providing top heat to assist with baking in an oven appliance having a gas bake burner. The top heat is provided by a heating element positioned in the top of the oven cavity. This top heating element is operated in a manner that assists the bottom, gas bake burner with properly browning the food on both its top and bottom. The operation of the both the top heating element and the gas bake burner can be varied to provide proper cooking and browning based upon e.g., the type of food being cooked, the amount of food being cooked, and the level of browning desired.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
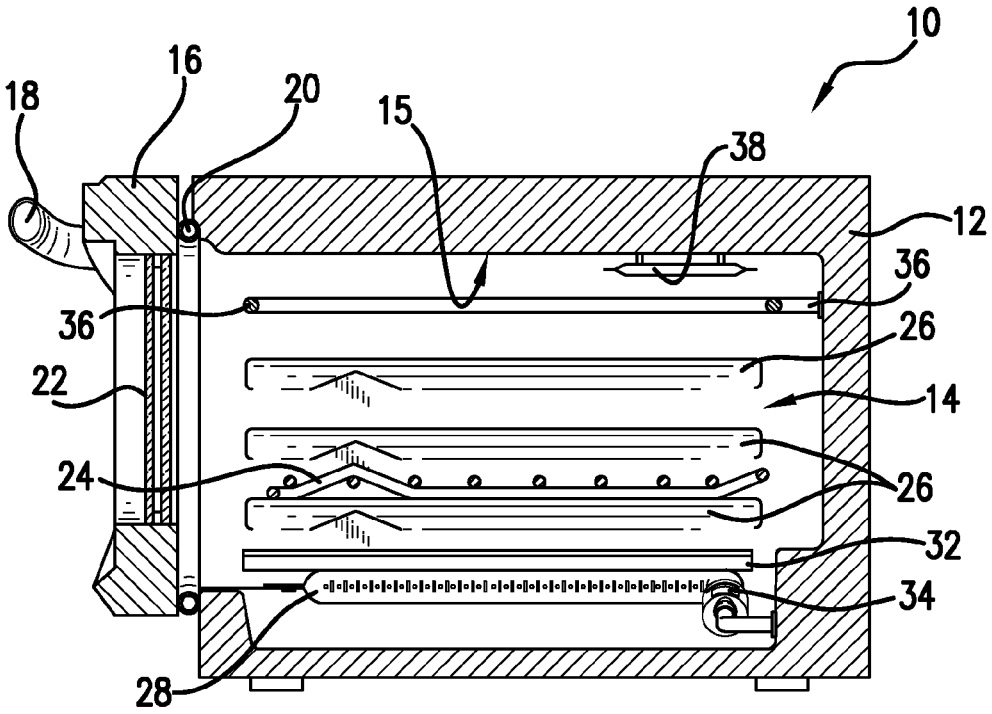
FIG. 2 is a side, partial cross-sectional view of the exemplary embodiment of FIG. 1.

FIGS. 1 and 2 illustrate an exemplary embodiment of a gas oven appliance 10 of the present invention. Oven 10 includes an insulated cabinet 12 that includes an interior cooking cavity 14 defined by an interior surface 15 and is configured for the receipt of one or more food items to be cooked. Oven 10 includes a door 16 hingedly attached to cabinet 12. Handle 18 allows for access to cavity 14. Seal 20 provides for maintaining heat and cooking fumes within cavity 14 when door 16 is closed as shown in FIG. 2. Double glass panes 22 provide for viewing the contents of cavity 14 when door 16 is closed. A baking rack 24 is positioned in cavity 14 for the receipt of food items or utensils containing food items. Baking rack 24 is slidably received onto embossed ribs 26 such that rack 24 may be conveniently moved into and out of cavity 14 when door 16 is open.

A gas fueled, bottom heating element 28 (e.g., a gas bake burner) is positioned in cabinet 12 below a protective guard 32. Heating element 28 is used to heat cavity 14 for both cooking and cleaning of oven 10. A shutter 34 allows for the adjustment of air flow to feed the combustion of fuel. The size and heat output of heating element 28 can be selected based on the e.g., the size of oven 10.

A top heating element 36 is also positioned in cabinet 12. For this exemplary embodiment of oven 10, heating element 36 is electrically powered and may be constructed from e.g., a calrod. The heat output of heating element 36 may be selected based on e.g., the size of oven 10 and the rate of browning desired. Preferably, heating element 36 is constructed from a calrod operating on 120 VAC. However, 240 VAC as well as other constructions and VAC levels may be used as well. In addition, a gas fueled heating element may also be used instead of electric heating element 36.

The operation of oven 10 including heating elements 28 and 36 is controlled by one or more processing devices (not shown) such as a microprocessor or other device that is in communication with such components. Such processing device (used herein to refer generally to single and/or multiple processing devices) is also in communication with a temperature sensor 38 that is used to measure temperature inside cavity 14 and provide such measurements to the process device. Temperature sensor 38 is shown (in FIG. 2) in the top and rear of cavity 14. However, other locations may be used and, if desired, multiple temperature sensors may be applied as well.

The temperature measurements from sensor 38 may be used directly or various algorithms may be applied to the measurements by the processing device. For example, such algorithms may be used to provide corrections to the temperature measurements provided by sensor 38 in order to more accurately determine the actual temperature at the center of the oven cavity 14, referred to herein as the Center Oven Temperature or COT. Due to e.g., the location of temperature sensor 38, the emissivity of coatings on the interior surface 15 of cavity 14, the cooking mode, and other factors, the COT may be different than the temperature measured by sensor 38. Because food is generally placed in the cavity 14 at or near its center, COT provides a more accurate measurement of the actual temperature applied to the food.

Oven 10 is provided by way of example only. The present invention may be used with other oven configurations. For example, the present invention may be used with an oven defining multiple interior cavities for the receipt of food and/or having different pan or rack arrangements than what is shown in FIG. 2. Still other configurations may also be used as will be understood by one of skill in the art using the teachings disclosed herein.

Figure 3:
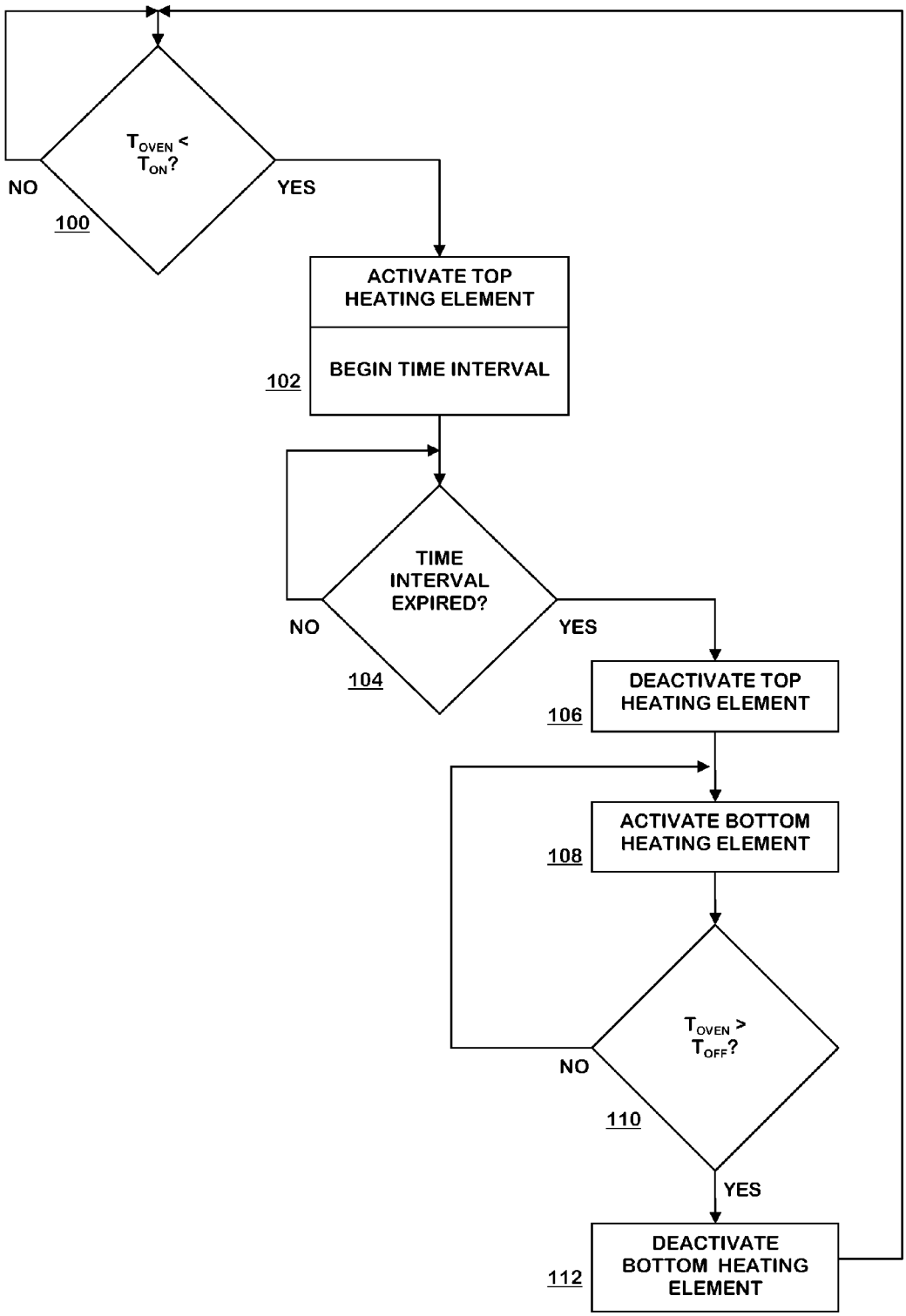
FIG. 3 provides a flow chart illustrating an exemplary method of operation of the present invention.

FIG. 3 provides a flowchart illustrating the operation of oven 10. Once oven 10 is turned on, temperature sensor 38 begins providing measurements of the temperature in cavity 14, referred to herein as $T_{OVEN}$, to the processing device. As stated previously, these temperature measurements may be used directly or an algorithm may be applied to determine the COT. Regardless, in step 100, the processing device uses such measurements to determine whether the temperature of the oven, $T_{OVEN}$, is less than a first predetermined temperature, $T_{ON}$. If not, then the processing device continues to monitor the temperature measurements. If $T_{OVEN}$ is less than $T_{ON}$, then the processing device activates the top heating element 36 in step 102. As such, the top heating element 36 provides heat into cavity 14 and also provides for the browning of the top of a food item (not shown) placed on rack 24.

While various sizes may be used for top heating element 36 as previously mentioned, preferably element 36 is sized so that it has enough heat output to brown the top of the food but not enough to substantially increase the temperature of cavity 14. In this configuration, bottom heating element 28 operates to provide most of the heat for controlling the temperature of the oven and browning the bottom of the food while top heating element 36 is primarily used for browning the top of the food.

In addition, in step 102, the processing device starts a timer. This timer operates for a predetermined time interval that is the sum of i) the time required to activate the top heating element 36 and ii) the time desired for heat output by element 36. Accordingly, upon initialization of this timer in step 102, the top heating element 36 is turned on for the duration of the predetermined time interval.

In step 104, the processing device continues heat output by top heating element 36 while determining whether the predetermined time interval has expired. If the time interval has not expired, heat output by heating element 36 is continued. If the processing device determines that the time interval has expired, then the top heating element 36 is turned off.

Next, bottom heating element 28 is activated in step 108. After turning on bottom heating element 28, the processing device monitors temperature measurements from sensor 38 to determine whether the temperature of the oven, $T_{OVEN}$, is greater than a second predetermined temperature, $T_{OFF}$. In step 110, while $T_{OVEN}$ is less than $T_{OFF}$, the processing device continues to leave bottom heating element 28 turned on, supplying heat to the oven and providing for the browning of food, particularly at the bottom of the food. Eventually, the heat provided by bottom heating element 28 will increase $T_{OVEN}$ to a temperature above $T_{OFF}$. Then, once the processing device determines in step 110 that $T_{OVEN}$ is greater than $T_{OFF}$, the processing device turns off the bottom heating element in step 112.

The processing device then returns to step 100 and begins monitoring $T_{OVEN}$ again to determine when $T_{OVEN}$ is less than the first predetermined temperature $T_{ON}$. Eventually, the temperature of oven 10 will drop as the oven cools, and $T_{OVEN}$ will fall below $T_{ON}$. The cycle of FIG. 1 is then continued until oven 10 is turned off manually or e.g., by the processing device operating according to a timer or other cooking algorithm.

The values for $T_{ON}$, $T_{OFF}$, and the time interval for the operation of the top heating element are predetermined and can be provided as part of the programming of the processing device. For example, these values can be determined experimentally for various foods as different foods such as poultry, beef, breads, and others will have different values needed for the proper cooking and browning of the food. These values can also be affected by the quantity of food cooked, the level of browning desired for the food, as well as the amount of heat output available from heating elements 28 and 36. If desired, for example, the processing device can be provided with multiple algorithms having different values for $T_{ON}$, $T_{OFF}$, and the time interval for operation of the top heating element. Based on user provided input and/or feature selection through e.g., a touch panel (not shown), an algorithm can be selected and operated by the processing device according to the exemplary method illustrated in FIG. 3 to provide cooking and browning based on the feature input/selection provided by the user.

As set forth above, $T_{ON}$ (the first predetermined temperature) is the temperature at which the processing device calls for heat from top heating element 36, while $T_{OFF}$ (the second predetermined temperature) is the temperature at which the processing device ceases a call for heat from bottom heating element 28. It should be understood that $T_{ON}$ and $T_{OFF}$ may have the same temperature value or may be of different values depending again on the quantity of food cooked, the level of browning desired for the food, as well as the amount of heat output available from heating elements 28 and 36.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating an oven cooking appliance, the oven having a top heating element and a bottom heating element, the bottom heating element being gas fueled, the method comprising the steps of:

activating the top heating element for a predetermined period of time when the oven temperature drops below a first predetermined temperature;

deactivating the top heating element after expiration of the predetermined interval of time;

activating the bottom heating element until the oven temperature reaches a second predetermined temperature after said step of deactivating the top heating element;

deactivating the bottom heating element after the oven temperature reaches the second predetermined temperature; and reducing the oven temperature to about the first predetermined temperature after said step of deactivating the bottom heating element.

2. A method for operating an oven cooking appliance as in claim 1, further comprising the step of repeating said steps of activating the top heating element, deactivating the top heating element, activating the bottom heating element, and deactivating the bottom heating element while cooking food in the oven.

3. A method for operating an oven cooking appliance as in claim 1, further comprising the step of measuring the temperature of the oven to determine if the oven temperature is less than the first predetermined temperature.

4. A method for operating an oven cooking appliance as in claim 1, further comprising the step of measuring the temperature of the oven to determine if the oven temperature is greater than the second predetermined temperature.

5. A method for operating an oven cooking appliance as in claim 1, wherein said top heating element comprises a calrod.

6. A method for operating an oven cooking appliance as in claim 1, wherein said top heating element comprises a gas burner.

7. A method for operating an oven cooking appliance as in claim 1, wherein the amount of the predetermined period of time is determined experimentally.

8. A method for operating an oven cooking appliance as in claim 1, wherein the amount of the predetermined period of time is based upon the identity of food being cooked by the oven.

9. A method for operating an oven cooking appliance as in claim 1, wherein the amount of the predetermined period of time is based upon the amount of food being cooked by the oven.

10. A method for operating an oven cooking appliance as in claim 1, wherein the amount of the predetermined period of time is determined experimentally based upon a predetermined amount of top browning of a food.

11. A method for operating an oven cooking appliance as in claim 1, wherein the predetermined temperature is determined based on the food to be cooked.

12. An oven appliance for cooking, comprising:

a top heating element;

a bottom heating element;

a cavity for receipt of a food for cooking;

one or more processing devices, wherein during cooking operation said one or more processing devices are configured for activating the top heating element for a predetermined period of time when the oven temperature drop below a first predetermined temperature;

deactivating the top heating element after the expiration of the predetermined interval of time;

activating the bottom heating element until the oven temperature reaches a second predetermined temperature after said step of deactivating the top heating element;

deactivating the bottom heating element after the oven temperature reaches the second predetermined temperature; and reducing the oven temperature to about the first predetermined temperature after said step of deactivating the bottom heating element.

13. An oven appliance for cooking as in claim 12, wherein said one or more processing devices are further configured for repeating said steps of activating the top heating element, deactivating the top heating element, activating the bottom heating element, and deactivating the bottom heating element during the cooking of food.

14. An oven appliance for cooking as in claim 12, further comprising a temperature sensor positioned within said cavity, said temperature sensor configured for providing temperature measurements to said one or more processing devices.

15. An oven appliance for cooking as in claim 14, wherein said one or more processing devices are further configured for receiving temperature measurements to determine if the temperature of the oven is less than the first predetermined temperature.

16. An oven appliance for cooking as in claim 14, wherein said one or more processing devices are further configured for receiving the temperature measurements to determine if the temperature of the oven is greater than the second predetermined temperature.

17. An oven appliance for cooking as in claim 12, wherein said top heating element comprises a calrod.

18. An oven appliance for cooking as in claim 12, wherein the amount of the processing device is configured to selected values for one or more of the predetermined period, the first predetermined temperature, and the second predetermined temperature based upon input provided by the user.

19. An oven appliance for cooking as in claim 12, wherein the amount of the predetermined period of time is based upon the identity of food being cooked by the oven.

20. An oven appliance for cooking as in claim 12, wherein the amount of the predetermined period of time is based upon the amount of food being cooked by the oven.

* * * * *